US011877647B2

(12) United States Patent
Jiang

(10) Patent No.: US 11,877,647 B2
(45) Date of Patent: Jan. 23, 2024

(54) INNER SUPPORT PANEL AND APPLICATIONS

(71) Applicant: Jinglei Jiang, Yuyao (CN)

(72) Inventor: Jinglei Jiang, Yuyao (CN)

( * ) Notice: Subject to any disclaimer, the term of this patent is extended or adjusted under 35 U.S.C. 154(b) by 186 days.

(21) Appl. No.: 17/630,157

(22) PCT Filed: Jul. 27, 2020

(86) PCT No.: PCT/CN2020/104799
§ 371 (c)(1),
(2) Date: Jan. 25, 2022

(87) PCT Pub. No.: WO2021/013267
PCT Pub. Date: Jan. 28, 2021

(65) Prior Publication Data

US 2022/0279922 A1 Sep. 8, 2022

(30) Foreign Application Priority Data

Jul. 25, 2019 (CN) ..... 201910678593.X
Jul. 22, 2020 (CN) ..... 202021466148.1
Jul. 22, 2020 (CN) ..... 202010711308,2

(51) Int. Cl.
*A47B 13/08* (2006.01)

(52) U.S. Cl.
CPC ..... *A47B 13/08* (2013.01); *A47B 2200/001* (2013.01)

(58) Field of Classification Search
CPC ..... A47B 3/0915; A47B 3/083; A47B 3/087; A47B 13/003; A47B 13/08; A47B 13/10;
(Continued)

(56) References Cited

U.S. PATENT DOCUMENTS 11,147,377 B2 * 10/2021 Lin ..... B29C 49/02
2005/0160950 A1 * 7/2005 Haney ..... A47B 13/08 108/129

(Continued)

FOREIGN PATENT DOCUMENTS

CN 203493067 * 3/2014
CN 205849065 * 1/2017
JP 11207807 * 8/1999

OTHER PUBLICATIONS

JP11207807 English abstract (Year: 1999).*
CN205849065 English translation (Year: 2017).*
CN203493067 English translation (Year: 2014).*

*Primary Examiner* — Janet M Wilkens
(74) *Attorney, Agent, or Firm* — Raymond Y. Chan; David & Raymond Patent Firm

(57) ABSTRACT

An inner support panel includes a first partial panel, a second partial panel, a first layer, a second layer a first panel portion, a second panel portion, a first layer, a second layer, and at least one support structure. The first layer is stacked on the second layer. The first partial panel includes one or two combinations consisting of at least part of the first layer and at least part of the second layer. The second partial panel includes one or two combinations consisting of at least the other part of the first layer and at least the other part of the second layer. The first partial panel and the second partial panel are connected to each other and form a hollow structure by defining a cavity. At least part of the second partial panel extends towards the cavity to form the support structure. The first partial panel can be supported by the support structure.

15 Claims, 9 Drawing Sheets

(58) Field of Classification Search
CPC ..... A47B 13/088; A47B 2200/001; A47B 2003/0835
USPC ..... 108/161, 160, 901, 166–169, 174
See application file for complete search history.

(56) References Cited

U.S. PATENT DOCUMENTS

| | | | | |
|---|---|---|---|---|
| 2016/0270521 | A1* | 9/2016 | Jiang | A47B 3/091 |
| 2018/0071969 | A1* | 3/2018 | Anderson | B63B 34/20 |
| 2021/0022502 | A1* | 1/2021 | Jiang | B32B 3/30 |

* cited by examiner

INNER SUPPORT PANEL AND APPLICATIONS

BACKGROUND OF THE PRESENT INVENTION

Field of Invention

The present invention relates to plastic construction structure, and more particularly to an inner support panel and applications thereof.

Description of Related Arts

It is very common to use plastic materials to make products in daily life. Panel boards made of plastic materials may have the problem of insufficient structural strength. Thus, it is impossible to support large weight thereon, or it may collapse in the middle of the panel board after long-term use.

In order to enhance the structural strength of the plastic panel, the known solution is to optimize the composition of material. For example, adding some reinforcement materials to the plastic material to reinforce the strength of the plastic panel. This increases the requirements of manufacturing the material itself, resulting in higher costs increasing. In detail, the panel needs to meet a variety of performance requirements, such as scratch resistance and impact resistance. Structural strength is one of the requirements. For example, if the structural strength is needed to be increased without reducing other performances, it highly relays on the composition.

Another known solution is to provide a plurality of reinforcing ribs underneath the panel so as to better support the panel by the reinforcing ribs and enhance the overall strength of the panel. The reinforcing rib is similar as a beam structure and usually is extended in the length or width direction of the panel. Although the arrangement of the reinforcing ribs can prevent the panel from collapsing, it increases the overall weight of the panel. With the number of the reinforcing ribs increasing, it may also affect other applications of the panel due to excessive occupation of the space under the panel, such as folding. In the manufacturing process of panel with the reinforcing ribs, the thickness of the position where the reinforcing rib arranged is thicker, and the heat dissipation of the position with the reinforcing rib is slower than other positions during demolding, which affects the shrinkage of other positions of the panel, resulting in uneven shrinkage, and then affecting the normal using of the panel.

SUMMARY OF THE PRESENT INVENTION

In order to resolve the technical problem of the conventional art, the present invention provides an inner supporting panel formed by blow molding with good impact resistance, light weight, and stable structure.

Another technical aspect of the invention is to provide a material structure of an inner support panel formed by blow molding with good impact resistance, light weight, and stable structure.

Another technical aspect of the invention is to provide a triple-layer inner support panel formed by blow molding with good impact resistance, light weight, and stable structure.

According to the present invention, the foregoing and other objects and advantages are attained by a blow-molded inner support panel, which comprises an upper panel and a lower panel, wherein a hollow structure is formed by blow molding between the upper panel and the lower panel, wherein an improvement is that each of the upper panel and the lower panel comprises an outer layer and an inner layer, wherein a plurality portions of the lower panel is recessed in a direction towards the upper panel until that the inner layer of the lower panel and the inner layer of the upper panel are connected with each other to form a predetermined number of touching support members.

Preferably, each of the upper panel and the lower panel comprises an outer layer, an intermediate layer and an inner layer, wherein a plurality portions of the lower panel is recessed in a direction towards the upper panel until that the inner layer of the lower panel and the inner layer of the upper panel are fused with each other to form a predetermined number of touching support members in a predetermined distributed manner.

In order to improve the strength of the edge structure of the inner layer support board, the upper panel comprises an out-folding wall bending downwards on the outer edge. The lower panel comprises an in-folding wall bending downwards on the outer edge. The inner layer at the bottom of the out-folding wall and the inner layer at the bottom of the in-folding are integrated with each other.

In order to improve a structural strength of the inner support panel, each of the touching support members is shaped and configured in a point structure or a strip structure.

Further preferably, at least one reinforcing rib is provided in each of the touching support members.

Further preferably, each of the touching support members is provided with at least two reinforcing ribs. Correspondingly, each of the touching support members is provided with three connecting peak points which are arranged spaced apart from the two reinforcing ribs.

According to one embodiment of the present invention, for each layer of the raw material structure of the double layer blow-molded inner support panel, the outer layers of the upper and lower panels are made of a high-density polyethylene, and the inner layers of the upper and lower panels are made of a mixture selected from a high-density polyethylene, a metallocene polyethylene and a calcium carbonate, or a mixture selected from the group consisting of a high-density polyethylene, a metallocene polyethylene and a glass fiber.

Preferably, the mass percentage of the metallocene polyethylene is 10-15%, the mass percentage of the calcium carbonate is 15-20%, and the rest is the high-density polyethylene; or that, the mass percentage of the metallocene polyethylene is 10-15%, the mass percentage of the glass fiber is 15-25%, and the rest is the high-density polyethylene.

According to one embodiment of the present invention, for each layer of the raw material structure of the triple layer blow-molded inner support panel, the outer layers of the upper and lower panels are made of high-density polyethylene, the intermediate layer s of the upper and lower panels are made of a mixture selected from high-density polyethylene, metallocene polyethylene and calcium carbonate, or a mixture selected from high-density polyethylene, metallocene polyethylene and glass fiber, and the inner layers of the upper and lower panels are made of metallocene polyethylene.

According to one embodiment of the present invention, preferably, for the intermediate layer, the mass percentage of the high-density polyethylene used in the intermediate layer is 70-85% and the mass percentage of the calcium carbonate is 15-30%.

According to one embodiment of the present invention, preferably, for the intermediate layer, the mass percentage of the high-density polyethylene used in the intermediate layer is 60-85% and the mass percentage of the glass fiber is 15-40%.

Compared with the conventional art, the present invention has the advantage that the multi-layer blow-molded inner support panel merely provides a hollow structure being blow molded between the upper layer and the lower layer to form a lightweight, firm and crash-resistant plate-shaped structure, wherein a plurality portions of the lower panel is recessed in the direction towards the upper panel until that the plurality portions of the inner layer of the lower panel and the inner layer of the upper panel are connected with each other to form a predetermined number of the touching support members in a predetermined distributed manner, so as to improve the structural strength of the blow-molded support board. The outer layer can be made of materials with high surface strength, anti-scratch and oil stain resistance performance, and the inner layer can be made of materials with low thermoplastic shrinkage ratio to provide frame supporting force. If the material of the intermediate layer is with high toughness, elasticity and energy absorption, it can further effectively alleviate the damage to the inner support panel caused by impact and falling, so as to further improve the overall structural strength of the blow-molded inner support panel.

Another advantage of the invention is to provide an inner support panel and applications thereof, wherein the inner support panel can have better strength and does not have excessive requirements for manufacturing materials.

Another advantage of the invention is to provide an inner support panel and applications thereof, wherein the inner support panel can have better strength without increasing its overall weight.

Another advantage of the invention is to provide an inner support panel and applications thereof, wherein the inner support panel is designed as a multi-layer structure, that meets the various performance requirements of the inner support panel, such as scratch resistance and impact resistance. By meeting at least one performance for each layer, the performance requirements for the overall inner support panel are met, and the requirements for the materials for the overall inner support panel are reduced.

Another advantage of the invention is to provide an inner support panel and applications thereof, wherein the inner support panel can form a supporting portion, wherein the formation of the supporting portion has no need to increase its overall weight.

Another advantage of the invention is to provide an inner support panel and applications thereof, wherein the supporting portion of the inner support panel is formed by stretching, so the thickness of the inner support panel will not be increased compared to the unstretched one, thereby reducing the occurrence of uneven heat distribution during the manufacturing.

Another advantage of the invention is to provide an inner support panel and applications thereof, wherein the supporting portion of the inner support panel maintains less contact with the inner wall of the inner support panel while supporting, thereby reducing the occurrence of uneven heat loss during manufacturing.

Another advantage of the invention is to provide an inner support panel and applications thereof, wherein the surface of the inner support panel has scratch resistance and oil stain resistance, and at the same time, its overall structure is strong, not easy to deform, and has strong impact resistance.

Additional advantages and features of the invention will become apparent from the description which follows and may be realized by means of the instrumentalities and combinations particular point out in the appended claims. According to the present invention, the foregoing and other objects and advantages are attained by an inner support panel, which comprises:

a first panel portion;

a second panel portion;

a first layer;

a second layer; and at least one support member, wherein the first layer is laminated to the second layer, wherein the first panel portion comprises one or two selected from a combination of at least part of the first layer and at least part of the second layer, wherein the second panel portion comprises one or two selected from a combination of at least part of the first layer and other at least part of the second layer, wherein edges of the first panel portion and the second panel portion are connected to with other and surrounded to form a cavity so as to form a hollow structure, wherein at least part of the second panel portion is extended toward the cavity to form at least one support member, wherein the first panel portion can be supported by the support member.

According to one embodiment of the present invention, the support member is joined to the inner wall of the first panel portion.

According to an embodiment of the present invention, the support member and the inner wall of the first panel portion are maintained with a predetermined distance therebetween, and the first panel portion is moved towards the second panel portion when being pressed, wherein the support member can be supported by the second panel portion.

According to one embodiment of the present invention, the support member and the inner wall of the first panel portion are maintained with a predetermined distance therebetween, and a filling material is filled between the support member and the first panel portion.

According to one embodiment of the present invention, at least a partial depression of the second panel portion forms the support member and at least one depression is formed on the surface of the second panel portion.

According to one embodiment of the present invention, the support member of the second panel portion has at least one touching peak point, wherein the first panel portion is supported at the touching peak point.

According to one embodiment of the present invention, the inner support panel further comprises at least one reinforcing rib, wherein the at least one reinforcing rib is disposed in a depression position.

According to one embodiment of the present invention, the inner support panel further comprises a third layer, wherein the second layer is located between the first layer and the third layer, wherein the first panel portion comprises at least a part of the first layer, at least a part of the second layer, and at least a part of the third layer, wherein the second panel portion comprises at least other parts of the first layer, at least other parts of the second layer, and at least other parts of the third layer, wherein the first layer part, the second layer part, and the third layer part of the second panel portion are recessed in a predetermined position toward the cavity to form a plurality of spaced support members.

According to one embodiment of the present invention, the first layer is made of high-density polyethylene, and the third layer is made of high-density polyethylene, and the third layer is made of one or two materials selected from the group consisting of the high-density polyethylene plus the calcium carbonate, and the high-density polyethylene plus the glass fiber. The second layer is made of one or two materials selected from the group consisting of the metallocene polyethylene plus the calcium carbonate, and the metallocene polyethylene plus the glass fiber.

According to the present invention, the foregoing and other objects and advantages are attained by a table top, adapted for being supported on at least one supporting device to form a table, wherein the table top comprises:

a first panel portion;

a second panel portion;

a first layer;

a second layer; and at least one support member, wherein the first layer is laminated to the second layer, wherein the first panel portion comprises one or two selected from a combination of at least a part of the first layer and at least a part of the second layer, wherein the second panel portion comprises one or two selected from a combination of at least a part of the first layer and other at least a part of the second layer, wherein edges of the first panel portion and the second panel portion are connected with each other and surrounded to form a cavity so as to form a hollow structure, wherein at least a part of the second panel portion is extended toward the cavity to form at least one support member, wherein the first panel portion can be supported by the at least one support member, wherein the second panel portion of the table top is adapted to be supported on the at least one supporting device to form the table.

According to the present invention, the foregoing and other objects and advantages are attained by a table, wherein the table comprises:

at least one supporting device; and a table top, wherein the table top is supported by the supporting device, and the table top comprises:

a first panel portion;

a second panel portion;

a first layer;

a second layer; and at least one support member, wherein the first layer is laminated to the second layer, wherein the first panel portion comprises one or two selected from a combination of at least a part of the first layer and at least a part of the second layer, wherein the second panel portion comprises one or two selected from a combination of at least a part of the first layer and other at least a part of the second layer, wherein edges of the first panel portion and the second panel portion are connected with each other and surrounded to form a cavity so as to form a hollow structure, wherein at least a part of the second panel portion is extended toward the cavity to form at least one support member, wherein the first panel portion can be supported by the support member.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

One skilled in the art should understand is that in the disclosure of the present invention, the term "vertical", "horizontal", "up", "down", "front", "rear", "left", "right" and "vertical", "level", "top", "bottom", "inside" and "outside" indicates a location or position relationship is based on the location or position relationship between shown in the appended drawings, merely to facilitate the description of this invention and simplified description, rather than instructions referred to or implied devices or components must have a specific location, in a specific orientation structure and operation, so the above terms should not limit the invention.

It is understood that the term "a" should be understood as "at least one" or "one or more". In one embodiment the number of a component may be one, while in another embodiment the number of the component may be more than one, and the term "a" should not be understood as a quantitative limitation.

The invention is further described in detail with the illustrated embodiments and drawings.

Figure 1:
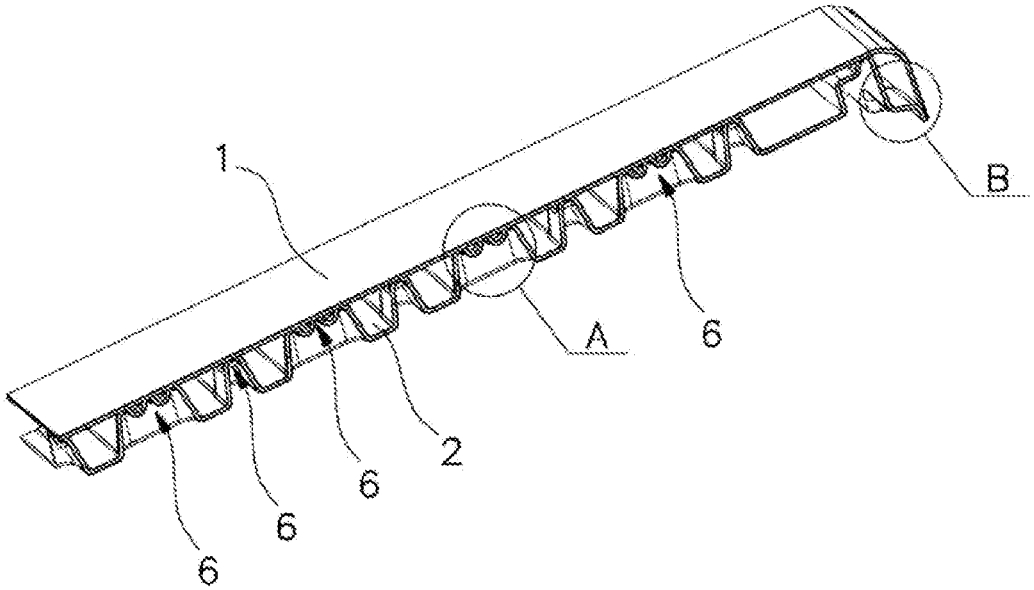
FIG. 1 is a sectional perspective view of an inner support panel according to a first preferred embodiment of the present invention.
Figure 2:
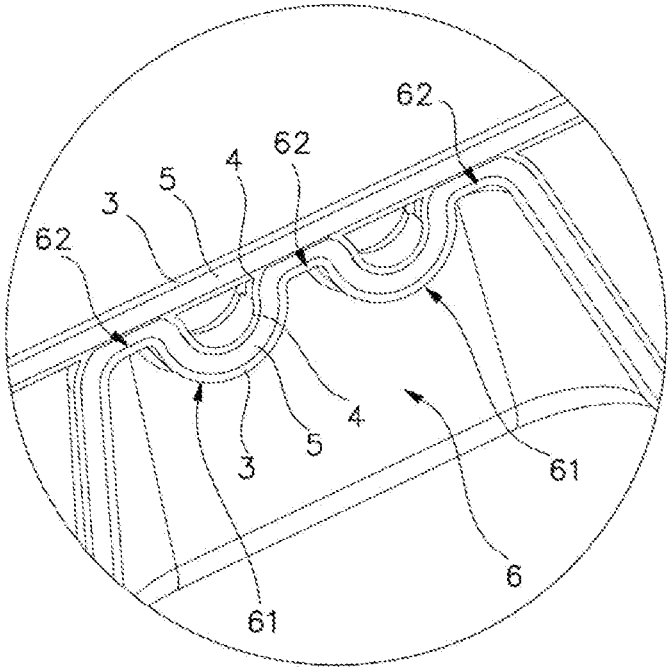
FIG. 2 is an enlarged view of portion A in FIG. 1.
Figure 3:
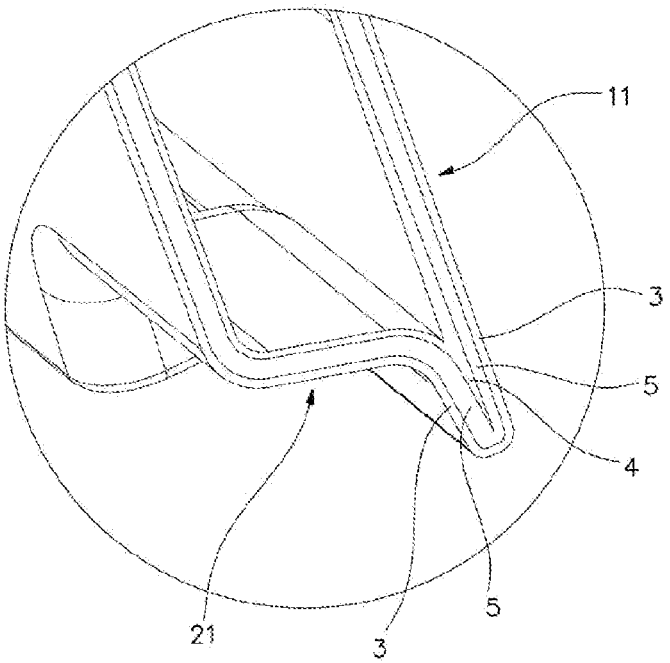
FIG. 3 is an enlarged view of portion B in FIG. 2.

As shown in FIGS. 1 to 3, a multilayer blow-molded inner support panel according to a first preferred embodiment of the present invention, comprises an upper panel 1 and a lower panel 2, wherein a hollow structure is formed between the upper panel 1 and the lower panel 2 during a blow molding formation process.

Each of the upper panel 1 and the lower panel 2 of this embodiment is a three-layer structure, that is each comprises an outer layer 3, an intermediate layer 5, and an inner layer 4. Further, a plurality portions of the lower panel 2 is upwardly recessed in a direction towards the upper panel 1 until the inner layer 4 of the lower panel 2 and the inner layer 4 of the upper panel 1 are fused and connected with each other to form a predetermined number of touching support members 6 in a predetermined distributed manner.

As shown in FIG. 3, an edge structure of the blow-molded inner support panel is illustrated as follows. An outer edge of the upper panel 1 has an out-folding wall 11 bent downwardly, and an outer edge of the lower panel 2 has an in-folding wall 21 bent downwardly. The inner layer 4 at a bottom of the out-folding wall 11 and the inner layer 4 at a bottom of the in-folding wall 21 are integrated and fused with each other.

According to this embodiment, each of the touching support members 6 has a strip-shape and is provided with two reinforcing ribs 61, as shown in FIGS. 1 and 2. Correspondingly, each of the touching support members 61 provides three connecting peak points 62 intervally spaced apart with the two reinforcing ribs 61.

A raw material structure of the double-outer single-inner three-layer blow-molded inner support panel is illustrated as follows. The outer layers 3 of the upper panel 1 and the lower panel 2 are made of high-density polyethylene, and the intermediate layers 5 of the upper panel 1 and the lower panel 2 are selected from a mixture of high-density polyethylene and calcium carbonate or a mixture of high-density polyethylene and glass fiber, and the inner layers 4 of the upper panel 1 and the lower panel 2 are both made of metallocene polyethylene.

In this way, the outer layer 3 has advantages of high surface strength, scratch resistance and oil resistance. The inner layer 4 has a low thermoplastic shrinkage ratio and provides frame structural supporting force. The intermediate layer 5 has certain elasticity, energy absorption and high toughness, so as to effectively alleviate the damage to the panel board caused by impact and fall.

According to the first preferred embodiment of the present invention, if the intermediate layer 5 is made of high-density polyethylene and calcium carbonate, a mass percentage of the high-density polyethylene is 70-85%, and a mass percentage of calcium carbonate is 15-30%.

According to the first preferred embodiment of the present invention, if the intermediate layer 5 is made of high-density polyethylene and glass fiber, a mass percentage of high-density polyethylene is 60-85%, and a mass percentage of glass fiber is 15-40%.

After the upper panel 1 and the lower panel 2 of the multi-layer blow-molded inner support panel of this embodiment is configured with the above-mentioned double-outer single-inner three-layer structure, when the outer layer 3 falls and is strongly impacted, the inner layer 4 may be broken to dissolve the impact force. Because the material of the intermediate layer 5 has a resilience tension, the inner layer 4 can still be reset to ensure the integrity and function of the entire inner support panel. As a result, the inner support panel has the advantages of high surface strength, high flatness, overall impact resistance, deformation resistance, more stable structure, higher performance, and longer service life span.

The multi-layer blow-molded inner support panel can be applied to many different applications. For example, the inner support panel can be constructed to produce a table or a chair, or utilized as a tabletop, a seat top or a back panel of a chair, or etc., The inner support panel can also be applied to other products whose panel boards may be broken easily, or applied as construction raw such as wall boards, door boards, fence boards, outdoor floors, insulation boards, partition boards, and etc.

According to the first preferred embodiment of the present invention, the parameters of the high-density polyethylene in the outer layer 3 are as follows: melting grease: 1.5 g/10 min, bending strength: 900 MPa, Shore: D69.

According to the first preferred embodiment of the present invention, the parameters of the high-density polyethylene in the intermediate layer 5 are as follows: melting grease: 0.35 g/10 min, bending strength: 1050 MPa, Shore D63.

According to the first embodiment of the present invention, the parameters of the metallocene polyethylene in the inner layer 4 are as follows:

Melting fat: 2.0 g/10 min;

Elongation at break: 420% in longitudinal direction and 830% in horizontal direction;

Tensile strength at break: longitudinal 62 MPa, horizontal 25 MPa;

Impact strength of falling dart <48 g;

Eikmandorf tearing strength: 21° C. in longitudinal direction, 430° C. in horizontal direction.

In addition, one skilled in the art would understand that, as a simplified embodiment, the outer layer, the intermediate layer, and the inner layer can be made of the same material, or different grades and levels of the same material, such as all made of high-density polyethylene. In addition, the outer layer can be made of higher grade materials with higher hardness and bright colors, the intermediate layer can be used as a mixed layer, and the inner layer can be made of recycled materials and a certain proportion of structural filling materials, which can achieve cost savings and quick color changes.

Second Embodiment

Figure 4:
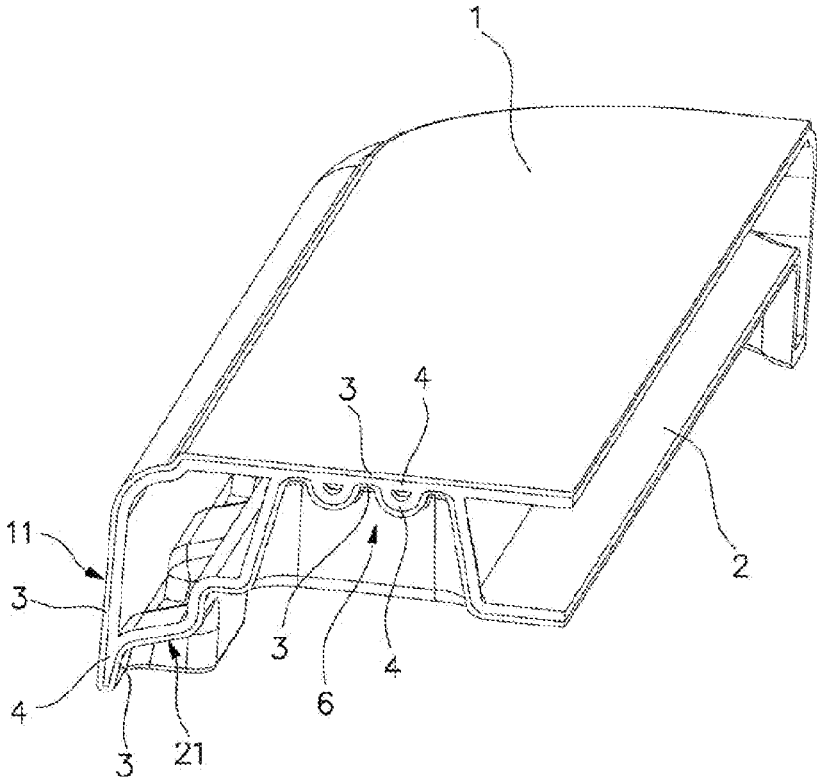
FIG. 4 is a partial sectional perspective view of an inner support panel according to a second preferred embodiment of the present invention.
Figure 5A:
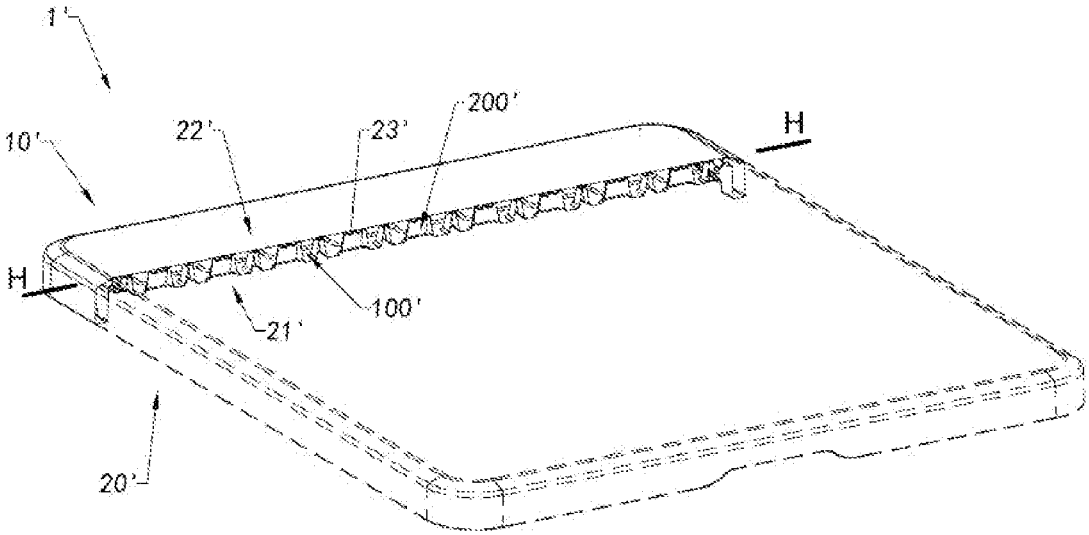
FIG. 5A is a sectional perspective view of an inner support panel according to a third preferred embodiment of the present invention.
Figure 5B:
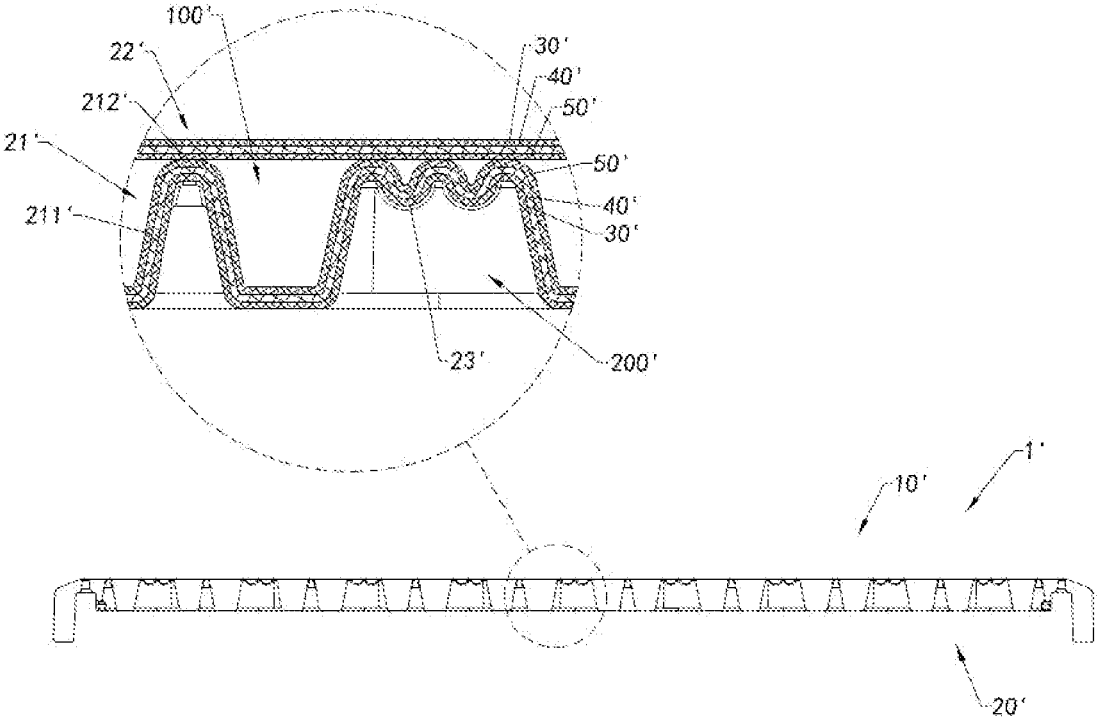
FIG. 5B is a sectional view with an enlarged view of the inner support panel according to the above third preferred embodiment of the present invention, along the H-H position in FIG. 5A.
Figure 6:
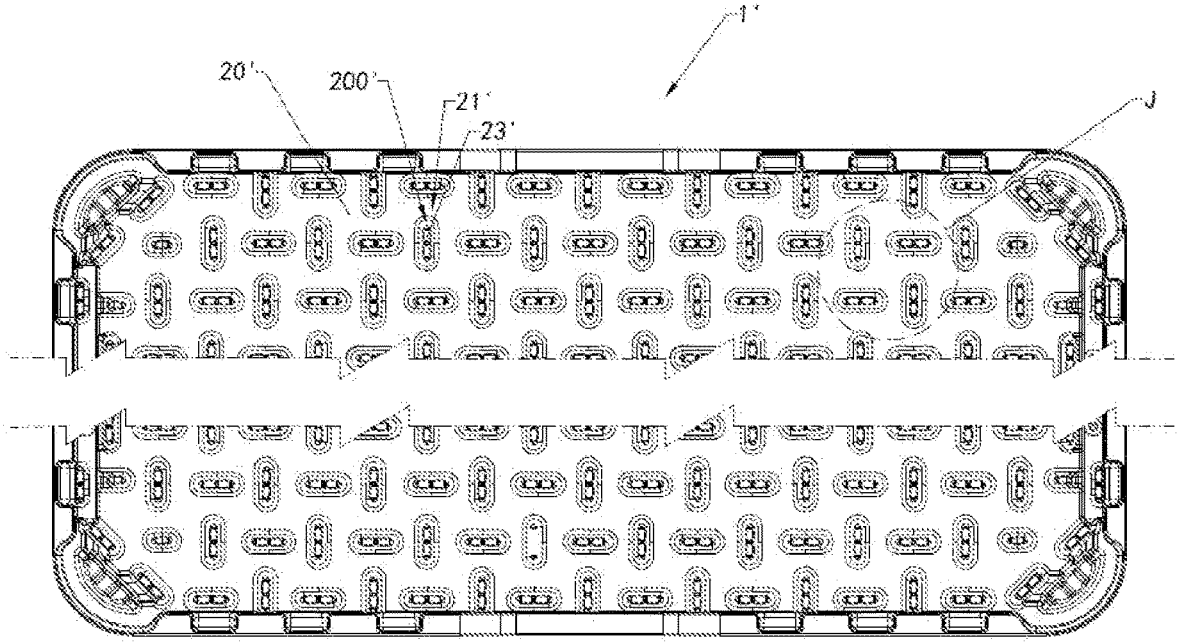
FIG. 6 is a bottom view of the inner support panel according to the above third preferred embodiment of the present invention, from another perspective.
Figure 7A:
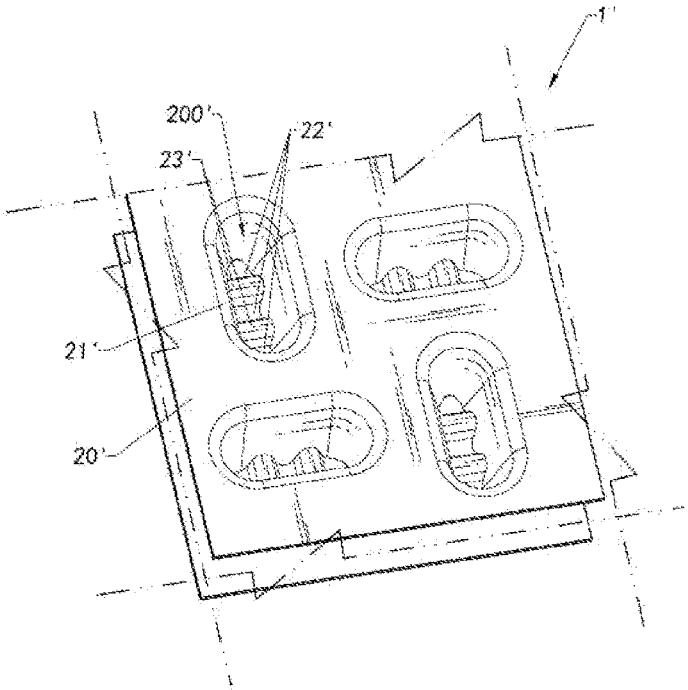
FIG. 7A is an enlarged partial perspective view of the inner support panel according to the above third preferred embodiment of the present invention, on the J position in FIG. 6.
Figure 7B:
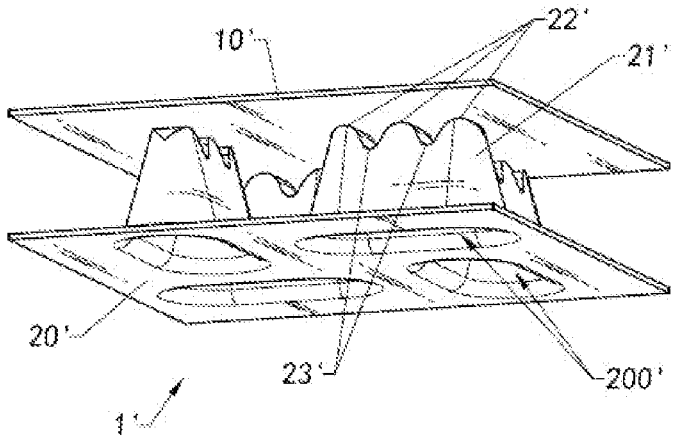
FIG. 7B is an enlarged partial perspective view of the inner support panel according to the above third preferred embodiment of the present invention, on the J position in FIG. 6 from another perspective.
Figure 7C:
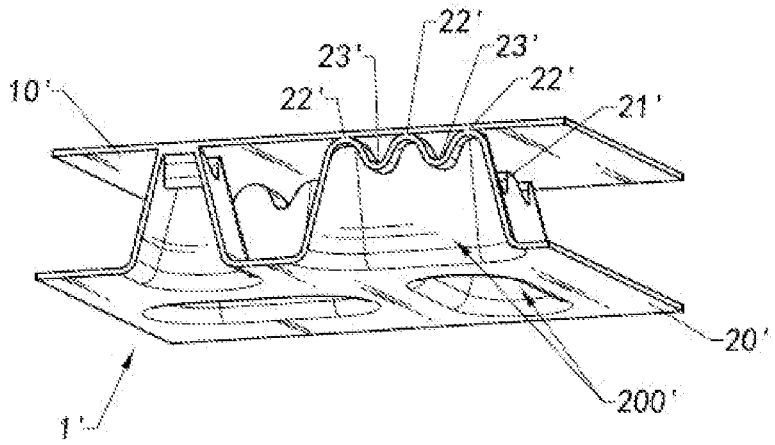
FIG. 7C is an enlarged sectional perspective view of the inner support panel according to the above third preferred embodiment of the present invention, on the J position in FIG. 6.

As shown in FIG. 4, according to a second preferred embodiment of the present invention, each of the upper panel 1 and the lower panel 2 of the second preferred embodiment is a double-layer structure. Each of the upper panel 1 and the lower panel 2 comprises an outer layer 3 and an inner layer 4. Further, a plurality portions of the lower panel 2 is recessed until the inner layer 4 of the lower panel and the inner layer 4 of the upper panel 1 are fused and connected with each other to form a predetermined number of touching support members 6 in a predetermined distributed manner.

The raw material structure of the double-layer blow-molded inner support panel is illustrated as follows. The outer layers 3 of the upper panel 1 and the lower panel 2 are made of high-density polyethylene, and the inner layers 4 of the upper panel 1 and the lower panel 2 are selected from a mixture of high-density polyethylene, metallocene polyethylene and calcium carbonate or a mixture of high-density polyethylene, metallocene polyethylene and glass fiber.

According to the second preferred embodiment of the present invention, for the inner layer, a mass percentage of the metallocene polyethylene is 10-15%, a mass percentage of calcium carbonate is 15-20%, and the rest is high-density polyethylene; or that, a mass percentage of the metallocene polyethylene is 10-15%, a mass percentage of glass fiber is 15-25%, and the rest is high-density polyethylene.

In addition, the parameter performance of the high-density polyethylene and the metallocene polyethylene used in this second preferred embodiment is the same as the illustration in the first preferred embodiment, and thus it is not being further repeated here.

The above disclosures are only preferred embodiments of the present invention. It should be noted that for those of ordinary skill in the art, without departing from the conceptual principle of the present invention, various modifications or improvements can be made to the present invention. For example, the outer layer, the intermediate layer and the inner layer of the upper panel, and the outer layer, the intermediate layer and the inner layer of the lower panel can also provide more than one layer, and these are all deemed to be within the scope of the present claimed invention.

According to FIGS. 5A to 7C, an inner support panel 1' according to a third preferred embodiment of the present invention is illustrated, wherein the inner support panel 1' is configured to provide better support strength without increasing the overall weight while no expensive manufacturing material is used to obtain better support strength.

In detail, the inner support panel 1' comprises a first panel portion 10' and a second panel portion 20', wherein the first panel portion 10' and the second panel portion 20' are connected with each other and surrounded to form a cavity 100' so as to provide a hollow structure. At least a part of the second panel portion 20' is extended towards the cavity 100', i.e. extended toward the first panel portion 10', to form at least one support member 21' with a predetermined depth, wherein the support member 21' is configured for supporting the first panel portion 10'.

During the inner support panel 1' is serviced, the first panel portion 10' faces a user or an object and can be used to support an object. That is, the first panel portion 10' is located outside, and the second panel portion 20' is located inside. The second panel portion 20' can support the first panel portion 10' to enhance a support strength of the first panel portion 10'.

The support member 21' has an upper end and a lower end, wherein the upper end of the support member 21' is close to the first panel portion 10' relative to the lower end. The upper end of the support member 21' is configured for supporting the first panel portion 10'.

The upper end of the support member 21' can be indirectly contact with the inner wall of the first panel portion 10', or can just be in contact with the inner wall of the first panel portion 10', or can be connected with the inner wall of the first panel portion 10' so as to join the first panel portion 10' at this position of the second panel portion 20'.

When the upper end of the support member 21' does not directly contact the inner wall of the first panel portion 10', that is the upper end of the support member 21' and the inner wall of the first panel portion 10' are maintained a certain distance which can filled between the first panel portion 10' and the support member 21', such as cushioning materials, to provide cushioning effect. Alternatively, the first panel portion 10' may be partially elastic. When the inner support panel 1' is not pressed, the upper end of the support member 21' and the inner wall of the first panel portion 10' are maintained at a certain distance. After the first panel portion 10' of the inner support panel 1' is pressed by an external force, the first panel portion 10' can move a little distance toward the second panel portion 20', so that the first panel portion 10' is supported by the support member 21'. Alternatively, during the manufacturing of the inner support panel 1', the first panel portion 10' and the support member 21' are maintained at a preset distance, and then the first panel portion 10' and the support member 21' are close to each other, so that the support member 21' can support the first panel portion 10'. Alternatively, the inner support panel 1' can have two usage modes, one is a supporting mode and the other is a non-supporting mode. In the supporting mode, the first panel portion 10' of the inner support panel 1' is supported by the support member 21' of the second panel portion 20'. In the non-supporting mode, the first panel portion 10' is not supported by the support member 21' of the second panel portion 20'. At least a part of the first panel portion 10' may be provided with a downward movable type. For example, pressing the first panel portion 10' can make the first panel portion 10' moving downward to be supported by the portion of the support member 21' of the panel board 20'.

In this embodiment, the support member 21' and the first panel portion 10' are joined with each other. In other words, at least a part of the inner wall of the second panel portion 20' and the inner wall of the first panel portion 10' are joined to each other.

It is understandable that the terminology "join" in the present invention should be interpreted as in contact with each other to fit together, or integrated with each other. For example, during the manufacturing process of the inner support panel 1', one or more parts of the material of the support member 21' and the materials of the first panel portion of the panel board 10' are integrated with each other.

For the inner wall of the first panel portion 10', one or more parts of the inner wall of the first panel portion 10' are in contact with the support member 21'. During the manufacturing process, a thickness of the contact position of the first panel portion 10' and the support member 21' is greater than that of other positions of the first panel portion 10', so that the heat dissipation is slower than other positions. The flatness of one or more parts of the panel board 10' have a certain influence. In other words, the area of the connection between the first panel portion 10' and the support member 21' cannot be too large. However, if the area of the connection between the first panel portion 10' and the support member 21' is too small, the support member 21' may be insufficient to support the first panel portion 10'. Therefore, the area of the inner wall of the first panel portion 10' that is in contact with the support member 21' and the area of the inner wall that is not in contact are needed to be controlled within a ratio range.

Further, as the area size of the inner support panel 1' expands, the number of the support members 21' of the inner support panel 1' is increased. The support members 21' are arranged according to a predetermined manner. If the number of support members 21' is too small, the supporting strength for the first panel portion 10' may be insufficient. If the number of support members 21' is too large, it will make the uneven heat dissipation more serious.

It is worth to mention that the support of the support member 21' to the first panel portion 10' does not need the weight of the inner supporting panel board 1'. In other words, the existence of the support member 21' does not increase the weight of the inner supporting panel board 1'. In fact, the increase in the number of the support members 21' makes the inner wall of the second panel portion 20' thinner and facilitates the support of the first panel portion 10'.

In detail, the second panel portion 20' may be a panel board with a balanced thickness at the beginning, such as a flat panel board, and then formed to make at least part of the second panel portion 20' protrude or dent. The support member 21' is formed. During this process, the overall length dimension of the second panel portion 20' can remain unchanged, but the position where the support member 21' is formed or a nearby position is stretched, making the thickness thinner. In other words, the second panel portion 20' forms an inside support member, without changing the weight of the support member 21'.

The support members 21' can be arranged in a variety of methods, and the plurality of the support members 21' formed by the same inner supporting panel board 1' can be the same or different. From a sectional view of the second panel portion 20', the shape of the support member 21' can be, but is not limited to, a circle, a rounded rectangle, a long strip, and the like. It can be understood that the support members 21' may be arranged at intervals, and may be arranged at even intervals. The support member 21' may also be arranged without intervals.

When the support member 21' is shaped as a long strip, the plurality of support members 21' can be arranged in side by side manner, such as lines in horizontally and vertically, or in vertically and horizontally, or in crisscross. When the inner support panel 1' is pressed by a force in one direction, such as a horizontal direction, the support member 21' located in the other direction can resist this force, such as the support member 21' in a longitudinal direction. Arranging the support member 21' in this manner is beneficial to enhance the structural strength of the inner support panel 1'.

Further, for one support member 21', the support member 21' is formed with a connecting peak point 22', and the connecting peak point 22' is at a higher end of the support member 21' and is higher than the surrounding part. Each support member 21' may have only one connecting peak point 22', or may have multiple connecting peak points 22'.

In the above description, it has been mentioned that if the contact area of the second panel portion 20' and the first panel portion 10' is too large, it may cause uneven heat dissipation in the contact position and affect the flatness of the first panel portion 10'. In this embodiment, the support member 21' is formed with a plurality of the connecting peak points 22', and a certain distance is maintained between the adjacent connecting peak points 22'.

In detail, each of the support members 21' comprises a side wall 211' and a top wall 212', wherein the top wall 212' is surrounded by the side wall 211', and the top wall 212' is configured as undulating to form a plurality of connecting peak points 22'. For example, the top wall 212' is formed with a plurality of waveforms, and an apex of each waveform is the connecting peak point 22'. The multiple connecting peak points 22' formed in the same support member 21' may be at the same height or at different heights. For example, the first panel portion 10' and the support member 21' are integrated, the depth corresponding to each connecting peak point 22' may be different. In this embodiment, the connecting peak points 22' of the same support member 21' are located at the same height.

The number of connecting peak points 22' formed in each support member 21' may be one, two, three or more. Users can set according to their needs. In this embodiment, each of the support members 21' of the inner support panel 1' is formed with three connecting peak points 22'. The connecting peak point 22' can be observed from a cross sectional view of the inner support panel 1'.

It is understandable that the shape of the support member 21' is not limited to the above examples. For example, the support member 21' may have not top wall 212', and the side wall 211' is supported on the first panel portion 10'. For example, the top wall 212' of the support member 21' may be flat so that the touching peak point 22' is not formed. For example, the top wall 212 of the support member 21' can be hollowed.

Further, the surface of the second panel portion 20' of the inner support panel 1' is formed with a plurality of recessed cavities 200'. The recessed cavities 200' are arranged at intervals and correspond to the support member 21'. In detail, the second panel portion 20' is recessed toward the cavity at a preset position to form the support member 21' and at the same time the recessed cavity 200' is formed on the surface of the second panel portion 20'.

The recessed cavity 200' is set to have a W-shaped cross-section, and the overall shape can be in oblong, with two arc ends, the periphery of which is inclined upward and inward to form a reinforced the support member 21' of the second panel 20'.

Further, the inner support panel 1' comprises at least one reinforcing rib 23', wherein the reinforcing rib 23' is located at a position of the recessed cavity 200'. The reinforcing rib 23' can be observed from the outside of the second panel portion 20' of the inner support panel 1'. The reinforcing rib 23' is configured for providing reinforcing effect.

In this embodiment, each of the support members 21' is provided with a pair of the reinforcing ribs 23', and the reinforcing ribs 23' are evenly arranged across a bottom of the recessed cavity 200' in a horizontal direction, which is the top of the support member 21'. Each of the reinforcing ribs 23' has a U-shaped wave form, which may be integrally extended to the support member 21', or may be formed by at least part of the support member 21' extending outwardly.

It is worth to mention that the wave-shaped structure is a preferable reinforcement structure, so the pair of wave-shaped ribs 22' form the above-mentioned support member 21' with three touching peak points, which greatly strengthen the second panel portion 20' impact resistance and strength.

In this embodiment, at least a part of the top wall 212' of the support member 21' faces away from the cavity 100', which is, each of the reinforcing ribs 23' is protruded outwardly. In this embodiment, the reinforcing ribs 23' and the connecting peak points 22' are connected with each other. The part of the support member 21' between the two adjacent connecting peak points 22' is protruded outwardly to form the reinforcing rib 23'. It can be understood that the reinforcing rib 23' and the connecting peak point 22' may also be independent of each other. The reinforcing rib 23' can be directly arranged at the position of the support member 21' without affecting the formation of the touching peak point 22'.

The number of said reinforcing ribs 23' can be one, two, three or more. In this embodiment, the number of the connecting peak points 22' is three, and the number of the reinforcing ribs 23' is two. The adjacent reinforcing ribs 23' is maintained in a predetermined distance and do not interfere with each other. For the three connecting peak points 22' of each support member 21', the distance between adjacent connecting peak points 22' may be different or the same, and the distance may be based on design requirements.

It is understandable that the second panel portion 20' of the inner support panel 1' is formed with the connecting peak point 22', which does not mean that the support member 21' must be formed by recessing, and the connecting peak point 22' is formed on the basis of the support member 21'. At least part of the second panel portion 20' protruding toward the cavity may also form the touching peak point 22'.

Furthermore, the inner support panel 1' is a multi-layer structure. In the conventional panel board, the panel board is a single layer structure, which means that the first panel portion 10' and the second panel portion 20' are single layer structures and made of the same material. In this embodiment, the first panel portion 10' may have a single layer, double-layer or multi-layer structure, and the second panel portion 20' may have a single layer, double-layer or multi-layer structure, so that the entire inner support panel 1' is multi-layered in the thickness direction. For example, the first panel portion 10' is a single layer structure, and the second panel portion 20' can be a two or more layers structure. Or the first panel portion 10' is a two or more layers structure, and the second panel portion 20' can be a single layer structure. Or the first panel portion 10' is a double-layer structure, and the second panel portion 20' can be a single layer, double-layer or multi-layer structure. Or, the first panel portion 10' is single layer, double-layer or multi-layer structure, and the second panel portion 20' may be double-layer structure.

In detail, the inner support panel 1' comprises a first layer 30' and a second layer 40', wherein the first layer 30' and the second layer 40' are laminated with each other, the first layer 30' is an outer layer, and the second layer 40' is an inner layer. The first layer 30' and the second layer 40' may be completely overlapped with each other, or a size of the second layer 40' may be smaller than that of the first layer 30', or only part of the inner wall of the first layer 30' is overlapped with the second layer 40', or vice versa.

It is understandable that the terminology "layer" in the present invention does not mean that the first layer 30' or the second layer 40' must have a clear boundary line. The first layer 30' and the second layer 40' can be made of the same material. The boundary between the first layer 30' and the second layer 40' can be clear or vague such as fusion, bonding, or overlapped one-piece composite structure. The first layer 30' and the second layer 40' may also be made of different materials. Further, the first panel portion 10' comprises at least part of the first layer 30' and the at least part of the second layer 40', wherein the first layer 30' and at least part of the second layer 40' can be overlapped to form the first panel portion 10'.

The first panel portion 10' comprises one or two selected from a combination of at least part of the first layer 30' and at least part of the second layer 40', and the second panel portion 20' comprises one or more selected from a combination of at least part of the first layer 30' and at least part of the second layer 40'.

For panel boards with good performance, the inner support panel 1' generally needs to have good oil stain resistance, scratch resistance, impact resistance and good support strength. When the first layer 30' of the inner support panel 1' is located on the outer side and the second layer 40' is located on the inner side, the first layer 30' may be made of a material with good oil and scratch resistance The second layer 40' may be made of materials with impact resistance and better support strength. In other words, the material or structure of each portion of the inner support panel 1' does not required to be designed to be optimal or best. With distributed design, such as multi-layer design, material performance requirements of the inner support panel 1' are reduced. When the materials at each position of the inner support panel 1' meet certain performance requirements, the performance of the entire inner support panel 1' can meet the requirements.

Further, the inner support panel 1' comprises a third layer 50', wherein the second layer 40' is located between the first layer 30' and the third layer 50'. The first panel portion 10' comprises one or more selected from a combination of at least part of the first layer 30', at least part of the second layer 40', and at least part of the third layer 50'. The second panel portion 20' comprises one or more selected from a combination of at least part of the first layer 30', at least part of the second layer 40' and at least part of the third layer 50'.

As an intermediate layer, the second layer 40' may perform an energy absorbing function to buffer the impact force received when the inner support panel 1' is pressed. The second layer 40' can be elastic and even breakable. For example, when the impact force received by the inner support panel 1' is too strong when the inner support panel 1' is pressed, the second layer 40' can be configured to absorb the impact energy and break itself to relieve the impact on the first layer 30' and the third layer 50'.

As the inner layer, the third layer 50' can perform a supporting effect.

It can be understood that the materials of the first layer 30', the second layer 40' and the third layer 50' may also be the same. For example, the material of the second layer 40' and the third layer 50' can be the same, and both can be supportive.

It is worth to mention that since the second layer 40' and the third layer 50' are located inside the first layer 30', the second layer 40' and the third layer 50' are not observable to the users using the inner support panel 1'. Therefore, the color of the second layer 40' and the third layer 50' have no requirement and can be made of recycled materials.

In this embodiment, the first panel portion 10' is embodied to comprise at least part of the first layer 30', at least part of the second layer 40', and at least part of the third layer 50'. The second panel portion 20' is embodied to comprise at least part of the first layer 30', at least part of the second layer 40', and at least part of the third layer 50'. The support member 21' is formed on the second panel portion 20'. The part of the first layer 30', the part of the second layer 40', and the part of the third layer 50' of the second panel portion 20' that are located in the same thickness direction are simultaneously recessed towards the cavity 100' to form the support member 21'.

The part of the second layer 40' of the first panel portion 10' may be integrally extended or joined or connected to the part of the second layer 40' the second panel portion 20'.

The thickness of the first layer 30', the third layer 50' and the second layer 40' of the inner support panel 1' may be the same or different. In this embodiment, the third layer 50' is made to be thicker than the first layer 30' and the second layer 40', and the first layer 30' is made to be thicker than the second layer 40'. Manufacturers can design the thickness of each layer according to the users' needs.

Further, it can be understood that the thickness at different positions of each layer of the inner support panel 1' may be same or different. For example, when the first panel portion 10' and the second panel portion 20' form a corner position, the second layer 40' and the third layer 50' are thicker at the corner position for they are more possible to suffer collisions, while the second layer 40' and the third layer 50' may be thinner in other positions.

The first layer 30' can be made of high-density polyethylene material, and the third layer 50' as an intermediate layer can be made of high-density polyethylene material and calcium carbonate or high-density polyethylene material and glass fiber material. The second layer 40' as the inner layer may be made of metallocene polyethylene.

It is understandable that the materials of each layer of the inner support panel 1' are not limited to the above examples, and manufacturers can use corresponding materials according to the performance requirements of the users.

The inner support panel 1' can be manufactured in various methods, such as blow molding, molding, or adhesion layer-by-layer. It can be understood that the adjacent layers of the inner support panel 1' may be filled with adhesive to facilitate adhesion between adjacent layers.

Figure 8:
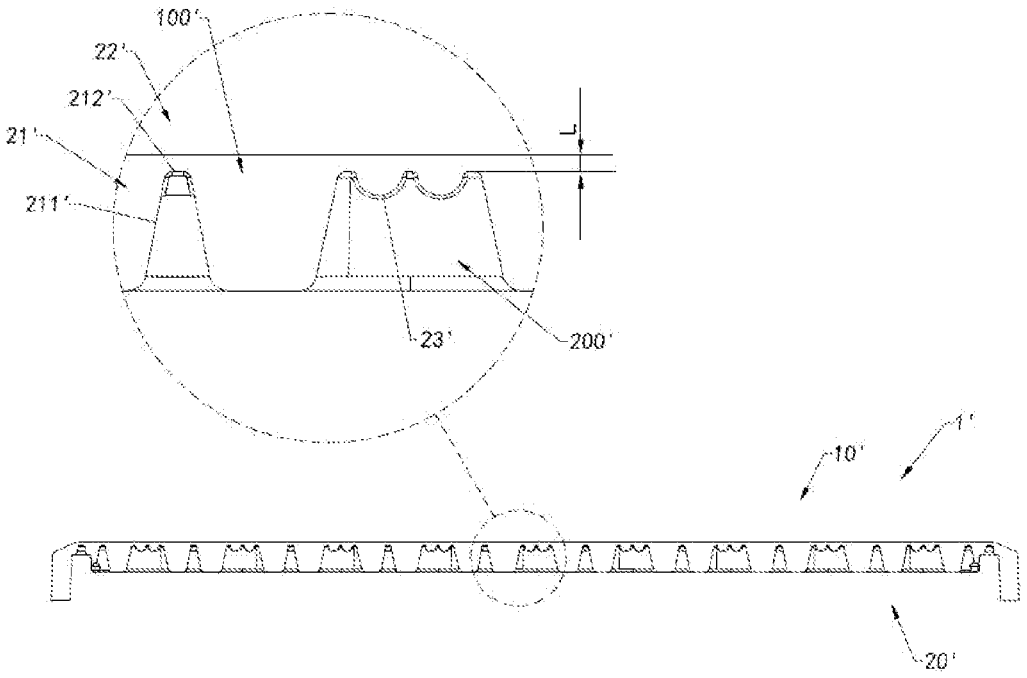
FIG. 8 is a sectional view with enlarged partial view of the inner support panel according to an alternative mode of the above third preferred embodiment of the present invention.

Referring to FIG. 8, another alternative mode of the inner support panel 1' according to the above third preferred embodiment of the present invention is illustrated.

The first panel portion 10' and the second panel portion 20' of the inner support panel 1' are not in contact except at the edge position. A large cavity 100' is formed surrounded by the first panel portion 10' and the second panel portion 20'.

At least a part of the second panel portion 20' is recessed toward the cavity 100' to form the support member 21' on the surface of the second panel portion 20' and form the connecting peak point(s) 22' inside the inner support panel 1'. The connecting peak point(s) 22' and the first panel portion 10' are maintained with a predetermined distance L. After the first panel portion 10' moves downward for a certain distance, the inner wall of the first panel portion 10' can be supported at the connecting peak point(s) 22' of the support member 21'.

Figure 9:
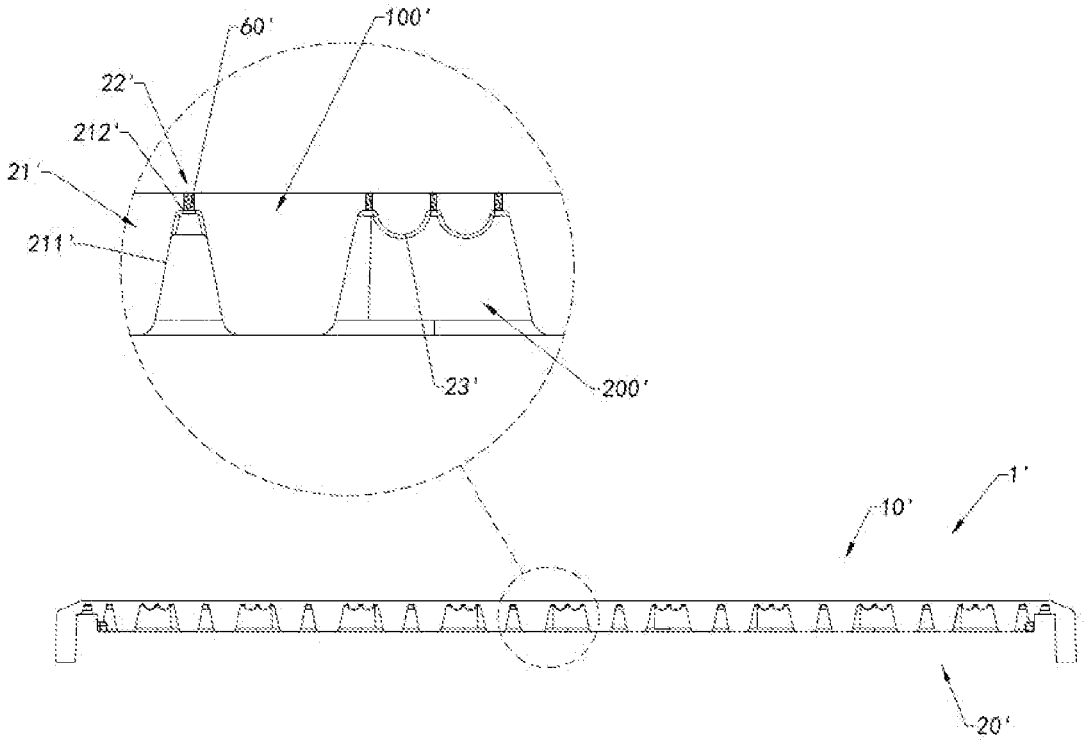
FIG. 9 is a sectional view with enlarged partial view of the inner support panel according to another alternative mode of the above third preferred embodiment of the present invention.

Referring to FIG. 9, another alternative mode of the inner support panel 1' according to the above third preferred embodiment of the present invention is illustrated.

The first panel portion 10' and the second panel portion 20' of the inner support panel 1' are not in contact except at the edge position. A large cavity 100' is formed surrounded by the first panel portion 10' and the second panel portion 20'.

The second panel portion 20' is protruded toward the first panel portion 10' to form the support member 21', and the connecting peak point(s) 22' of the support member 21' and the inner wall of the first panel portion 10' are maintained with a preset distance.

A filling material may be filled between the support member 21' and the first panel portion 10', and between the connecting peak point(s) 22' of the support member 21' and the first panel portion 10'. The filling material can, but is not limited to, have elastic supporting effect.

The filling material may form a filler layer 60', wherein the filler layer 60' is located between the support member 21' of the second panel portion 20' and the first panel portion 10'. The filler layer 60' can be, but is not limited to, filled and formed by injection molding after the first panel portion 10' and the second panel portion 20' are made. For example, the inner support panel 1' has holes in certain positions for filling in the material.

Since a predetermined distance is maintained between the adjacent support members 21', the cavity 100' can still be connective on the inner wall side of the second panel portion 20'.

Figure 10:
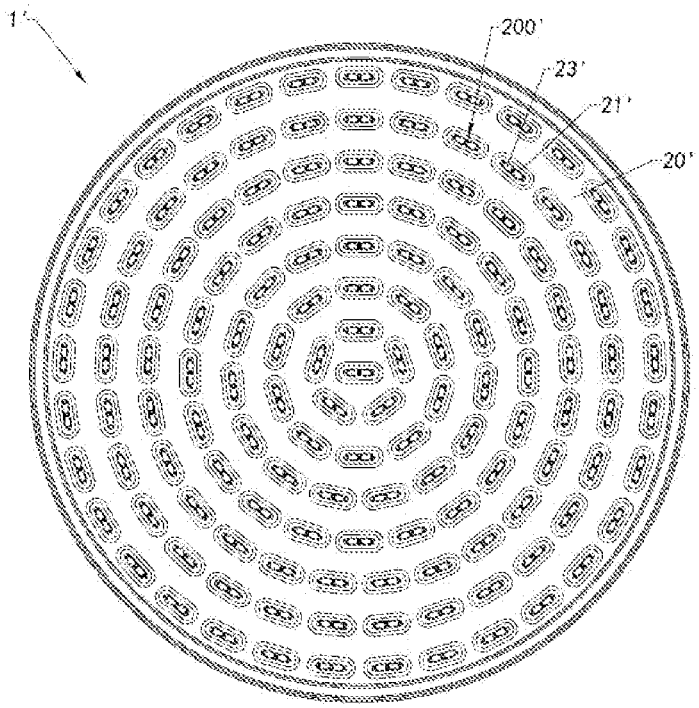
FIG. 10 is a schematic view of an inner support panel according to a fourth preferred embodiment of the present invention.

Referring to FIG. 10, the inner support panel 1' according to a fourth preferred embodiment of the present invention is illustrated.

The difference between this embodiment and the foregoing embodiments is the arrangement of the support members 21'. In this embodiment, a plurality of elongated support members 21' are arranged in a concentric circle, and the length direction of the support member 21' is located in a circumferential direction of the circle.

When the inner support panel 1' is folded along the surface and through a center of the circle, the inner support panel 1' has at least a part of the support member 21' while the direction of force is crossed, thereby facilitating the inner support strength of panel board 1'.

Figure 11:
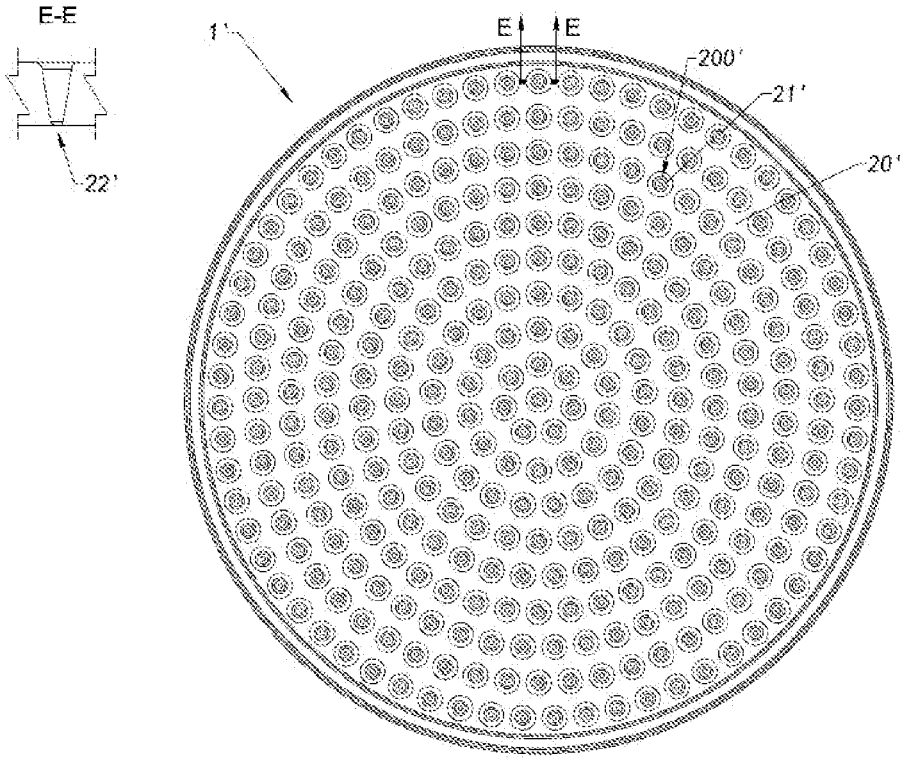
FIG. 11 is schematic view of an inner support panel according to a fifth preferred embodiment of the present invention.

Referring to FIG. 11, the inner support panel 1' according to a fifth preferred embodiment of the present invention is illustrated.

In this embodiment, the number of the connecting peak points 22' of the support member 21' formed by the second panel portion 20' is one, and that when viewed from outside of the second panel portion 20', a shape of the support member 21' is circular. The support members 21' are arranged at a certain interval distance.

Figure 12:
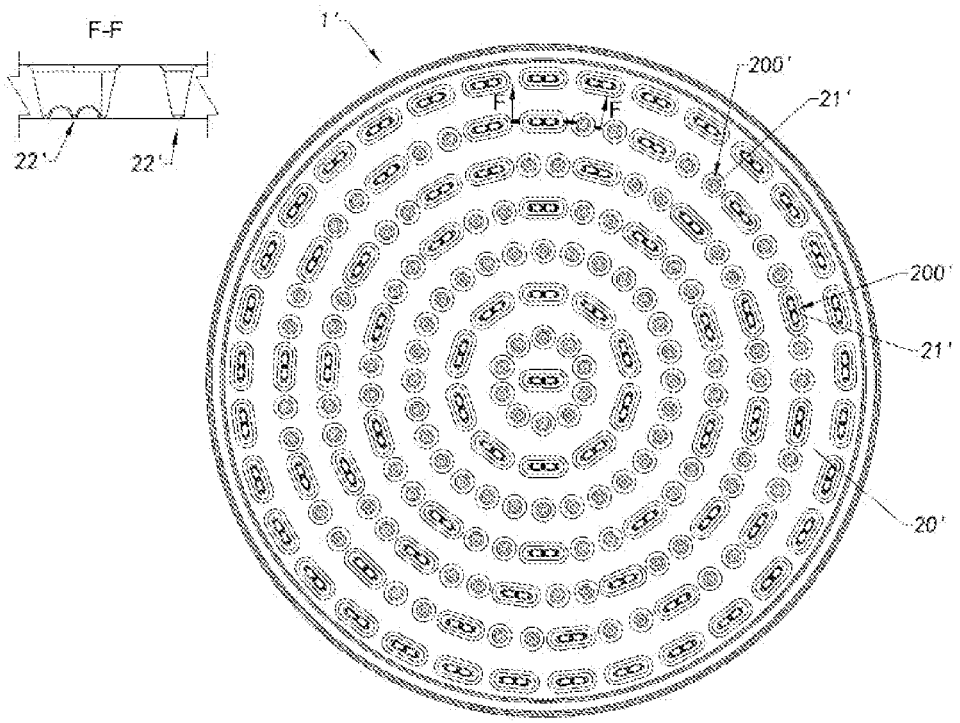
FIG. 12 is a schematic view of an inner support panel according to a sixth preferred embodiment of the present invention.
Figure 14:
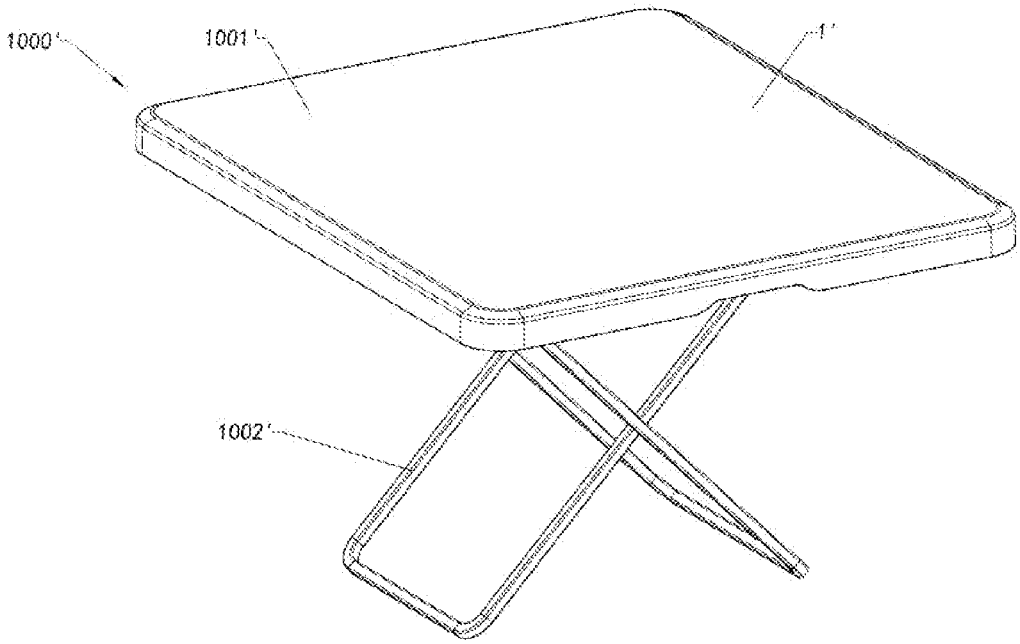
FIG. 14 is a perspective view of an application of the inner support panel according to the above preferred embodiments of the present invention.

Referring to FIG. 12, the inner support panel 1' according to a sixth preferred embodiment of the present invention is illustrated.

In this embodiment, the number of connecting peak point 22' of each of the plurality of support members 21' is one, and the number of connecting peak points 22' of the plurality of support members 21' is three. From outside view of the second panel portion 20', the shapes of some of the support members 21' are circular, and the shapes of the other of support members 21' are elongated.

The elongated support member 21' and the circular support member 21' are arranged at intervals.

According to another aspect of the present invention, the present invention provides a manufacturing method of the inner support panel 1', wherein the manufacturing method comprises steps of:

forming the layers of the inner support panel 1';

blowing gas toward a middle of the inner support panel 1' until the cavity 100' is formed by the first panel portion 10' and the second partial face so as to form a hollow structure; and forming the support member 21' recessed toward the cavity 100' on a surface of the second panel portion 20', wherein the support member 21' is configured for supporting the first panel portion 10'.

According to one embodiment of the present invention, at least one reinforcing rib 23' is formed on the support member 21'.

According to one embodiment of the present invention, each layer of the inner support panel 1', for example the first layer 30', the second layer 40', and the third layer 50', is separately molded, and then formed in predetermined steps to stack and form a panel board.

According to one embodiment of the present invention, each layer of the inner support panel 1', for example the first layer 30', the second layer 40', and the third layer 50', is simultaneously formed and then passed through a discharging channel to be extruded and joined to form a panel board at an exit position of the discharging channel.

According to one embodiment of the present invention, at least one layer of the inner support panel 1' is attached to another layer by spraying.

According to one embodiment of the present invention, at least one layer of the inner support panel 1' is formed by molding.

According to one embodiment of the present invention, each layer of the inner support panel 1', for example the first layer 30', the second layer 40', and the third layer 50', can be integrally formed. The first layer 30' is formed in one mould by molding, and is placed into another mould to be injected with the material of third layer 50', so as to obtain the laminated the first layer 30' and the third layer 50'. Then, the first layer 30' and the third layer 50' are placed in another mold, and the material of the second layer 40' is injected to obtain the first layer 30', so that the third layer 50' and the second layer 40' which are sequentially stacked.

It is understandable that in the above-mentioned manufacturing method, the support member 21' can be formed during making each layer of the inner support panel 1', and then each layer is aligned and installed. Alternatively, after the multi-layer structure of the inner support panel 1' is formed, the support member 21' is formed.

Further, the present invention provides another manufacturing method of the inner support panel 1', which comprises steps of:

forming the layers of the inner support panel 1';

blowing gas toward the middle of the inner support panel 1 ' until the cavity 100' is formed around the first panel portion 10' and the second panel portion 20' to form the hollow structure; and forming the touching peak point 22' with at least part of the second panel portion 20' extending toward the cavity, wherein the first panel portion 10' can be supported at the touching peak point 22'.

According to one embodiment of the present invention, the third layer 50' of the inner support panel 1' is protruded to form the touching peak point(s) 22'. The first layer 30' and the second layer 40' can be maintained in a flat state.

According to one embodiment of the present invention, the first layer 30', the second layer 40' and the third layer 50' of the inner support panel 1' are co-extended at a predetermined position to form the connecting peak point 22'.

It is understandable that the protruding extension part of the second panel portion 20' forming the connecting peak point 22' may be hollow or solid.

It is understandable that the support member 21' can be formed by integrally extending the second panel portion 20', or it can be installed separately. For example, it is arranged on the inner wall of the third layer 50' of the second panel portion 20' by adhesion. The support member 21' forms the connecting peak point(s) 22', and may be arranged at intervals on the inner wall of the third layer 50' of the second panel portion 20'.

Figure 13:
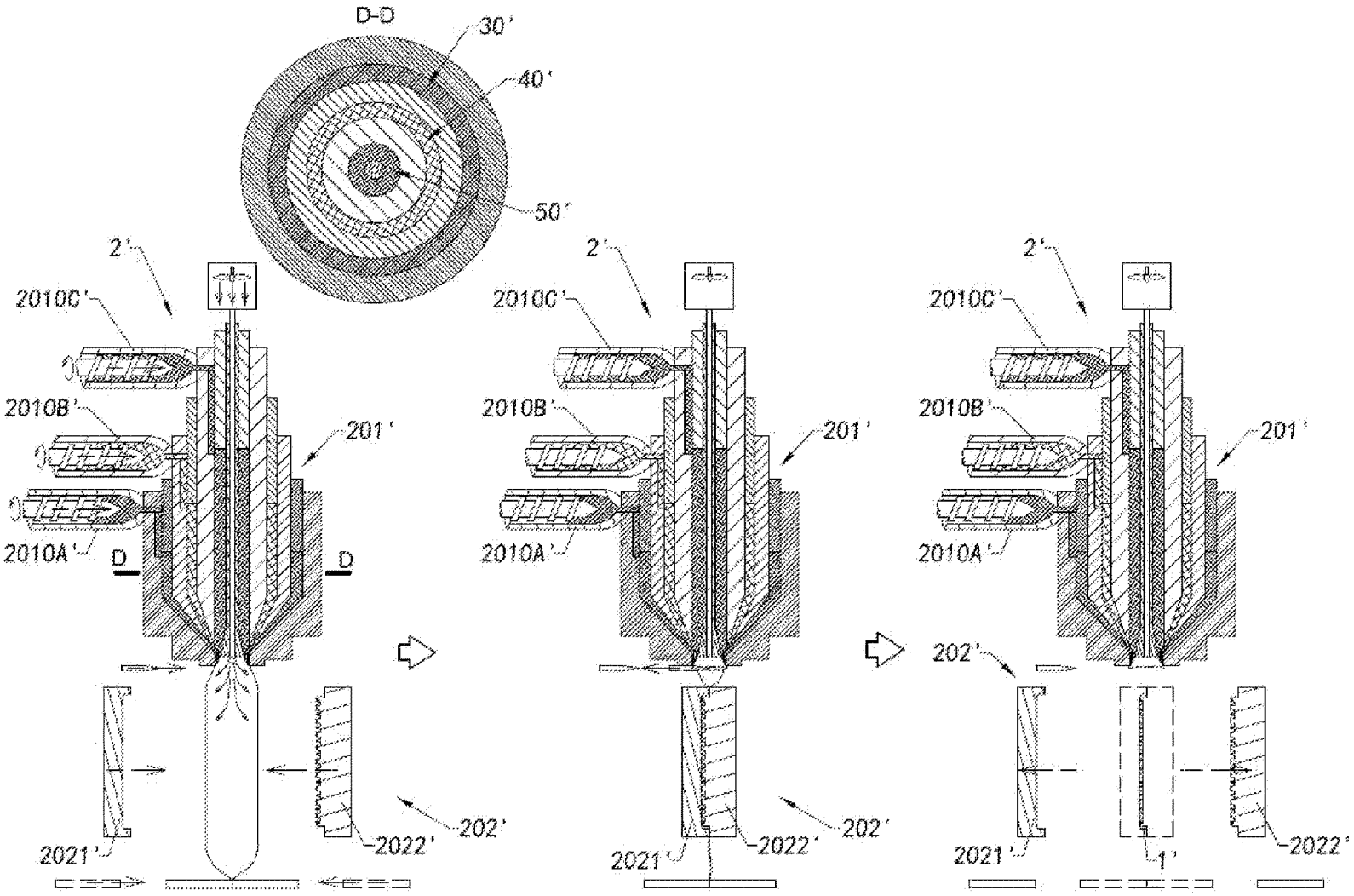
FIG. 13 is a schematic view illustrating a manufacturing method of the inner support panel according to a preferred embodiment of the present invention.

Referring to FIG. 13, a manufacturing method of the inner support panel 1' according to a preferred embodiment of the present invention is illustrated.

Firstly, raw materials for making the first layer 30', the third layer 50' and the second layer 40' are respectively extruded through a discharging device 201' of a manufacturing equipment 2'. In detail, the discharging device 201' comprises a first discharging channel 2010A', a second discharging channel 2010B', and a third discharging channel 2010C', wherein an inner diameter of the first discharging channel 2010A' is larger than an inner diameter of the second discharge channel 2010B' and the inner diameter of the second discharge channel 2010B' is larger than an inner diameter of the third discharge channel 2010C'. The first discharging channel 2010A', the second discharging channel 2010B' and the third discharging channel 2010C' are arranged in a ring-shaped concentric and circular configuration. The first discharge channel 2010A' is located at an outer position, the second discharge channel 2010B' is located in a middle position, and the third discharge channel 2010C' is located in an inner position.

The extruded first layer 30', the second layer 40' and the third layer 50' are joined with each other to form a primary bag body, while the cavity 100' is formed.

After the primary bag body drops to a certain height, blowing gas from an opening position above or below the primary bag body.

A left mould 2021' and a right mould 2022' of a forming mould 202' are used to extrude the primary bag body from both sides to be molded while maintaining inflation.

After the blowing is completed, the gas is exhausted to obtain the molded inner support panel 1'.

The support member 21' may be formed by extrusion of the forming mould 202'. It can be understood that keeping the gas blowing towards the primary bag body makes the first layer 30', the second layer 40' and the third layer 50' joined with each other more closely. During the extrusion process, the material is in a flowable state, and the materials of different layers may be connected with each other, thereby providing a tighter bonding effect.

It is understandable that, depending on the shape of the forming mold 202', the inner support panel 1' can be made into panel boards of different shapes, or the support member 21' of different shapes can be made with different distances. Or, the support members 21' with different connecting peak points 22' are formed.

Referring to FIG. 14 and FIGS. 5A to 7C, the application of the inner support panel 1' according to an embodiment of the present invention is illustrated.

The inner support panel 1' can be used as a tabletop. According to one embodiment of the present invention, the present invention provides a table 1000', wherein the table 1000' comprises the tabletop 1001' and at least one supporting device 1002'. Optionally, the number of the supporting device 1002' can be one, two, three or more. The tabletop 1001' is supported by the supporting device 1002'.

The tabletop 1001' comprises the first panel portion 10' and the second panel portion 20', wherein at least part of the first panel portion 10' and at least part of the second panel portion 20' are arranged face to face parallelly. The first panel portion 10' and the second panel portion 20' are connected with each other at an edge position, surrounding the cavity 100'. The second panel portion 20' is recessed toward the cavity to form the support member 21'.

The shape of the tabletop 1001' can be, but is not limited to, circular, a triangular, a rectangular, or the like.

It is understandable that the application of the inner support panel 1' is not limited to the field of the table 1000', and the inner support panel 1' can be used to make other furniture, such as cabinets, stools, chairs, and etc. Furthermore, the application field of the inner support panel 1' is not limited to the furniture field, and can also be used as construction panel or to make toys, shelves, and etc., and users can choose the inner support panel 1' according to their needs.

The materials and colors of the layers of the inner support panel 1' can be independently selected according to requirements.

One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and is subject to change without departure from such principles. Therefore, this invention comprises all modifications encompassed within the spirit and scope of the following claims.

What is claimed is:

1. An inner support panel, comprising:

a first panel portion, a second panel portion and a plurality of support members, wherein each of the first panel portion and the second panel portion comprises at least a first layer and a second layer, wherein the first layer is at least partially connected with the second layer to form the first panel portion and the second panel portion, wherein edges of the first panel portion and the second panel portion are connected with each other, wherein at least a part of the first panel portion and at least a part of the second panel portion are maintained with a predetermined distance to form a cavity between the first panel portion and the second panel portion, wherein a plurality portions of the second panel portion is recessed towards the first panel portion to form the plurality of support members to support the first panel portion, wherein each of the plurality of support members is extended in the cavity to form one or more touching peak points towards an inner wall of the first panel portion and at least one recessed cavity on the second panel portion, wherein the first panel portion comprises at least one selected from at least part of the first layer and at least part of the second layer, wherein the second panel portion comprises at least one selected from at least part of the first layer and other at least part of the second layer, wherein a predetermined distance is maintained between the one or more touching peak points of the one or more support members and the inner wall of the first panel portion, and the filling material is filled between the one or more support members and the inner wall of the first panel portion.

2. The inner support panel, as recited in claim 1, wherein the at least one recessed cavity of each of the one or more support members has a U-shaped cross section.

3. The inner support panel, as recited in claim 1, wherein each of the plurality of support members comprises at least one reinforcing rib extended from away from the first panel portion in the recessed cavity thereof.

4. The inner support panel, as recited in claim 3, wherein each of the plurality of support members comprises three the touching peak points and two the reinforcing ribs spaced intervally such that the recessed cavity of each of the plurality of support members has a W-shaped cross section.

5. The inner support panel, as recited in claim 4, wherein the first layer of each of the first panel portion and the second panel portion is an outer layer facing outside and the second layer of each of the first panel portion and the second panel portion is an inner layer facing the cavity, wherein one or more parts of the second layer of the first panel portion and one or more parts of the second layer of the second panel portion are fused with each other at the one or more touching peak points of each of the plurality of support members.

6. The inner support panel, as recited in claim 4, wherein each of the first panel portion and the second panel portion further comprises a third layer, wherein the second layer is formed between the first layer and the third layer, wherein the first layer of each of the first panel portion and the second panel portion is an outer layer facing outside and the third layer of each of the first panel portion and the second panel portion is an inner layer facing the cavity.

7. The inner support panel, as recited in claim 3, wherein the first layer of each of the first panel portion and the second panel portion is an outer layer facing outside and the second layer of each of the first panel portion and the second panel portion is an inner layer facing the cavity, wherein one or more parts of the second layer of the first panel portion and one or more parts of the second layer of the second panel portion are fused with each other at the one or more touching peak points of each of the plurality of support members.

8. The inner support panel, as recited in claim 3, wherein each of the first panel portion and the second panel portion further comprises a third layer, wherein the second layer is formed between the first layer and the third layer, wherein the first layer of each of the first panel portion and the second panel portion is an outer layer facing outside and the third layer of each of the first panel portion and the second panel portion is an inner layer facing the cavity.

9. The inner support panel, as recited in claim 1, wherein each of the plurality of support members comprises at least one reinforcing rib extended from away from the first panel portion in the recessed cavity thereof, wherein the one or more touching peak points and the at least one reinforcing rib are spaced apart intervally such that each of the plurality of the support members has a wave form cross section.

10. The inner support panel, as recited in claim 9, wherein each of the first panel portion and the second panel portion further comprises a third layer, wherein the second layer is formed between the first layer and the third layer, wherein the first layer of each of the first panel portion and the second panel portion is an outer layer facing outside and the third layer of each of the first panel portion and the second panel portion is an inner layer facing the cavity, wherein one or more parts of the third layer of the first panel portion and one or more parts of the third layer of the second panel portion are joined with each other at the one or more peak points of each of the plurality of support members.

11. The inner support panel, as recited in claim 1, wherein the first layer of each of the first panel portion and the second panel portion is an outer layer facing outside and the second layer of each of the first panel portion and the second panel portion is an inner layer facing the cavity, wherein one or more parts of the second layer of the first panel portion and one or more parts of the second layer of the second panel portion are fused with each other at the one or more touching peak points of each of the plurality of support members.

12. The inner support panel, as recited in claim 1, wherein each of the first panel portion and the second panel portion further comprises a third layer, wherein the second layer is formed between the first layer and the third layer, wherein the first layer of each of the first panel portion and the second panel portion is an outer layer facing outside and the third layer of each of the first panel portion and the second panel portion is an inner layer facing the cavity.

13. The inner support panel, as recited in claim 12, wherein the first layer is made of high-density polyethylene, wherein the second layer is made of a mixture material selected from the group consisting of high-density polyethylene plus calcium carbonate, and high-density polyethylene plus glass fiber, wherein the third layer is made of a material of metallocene polyethylene.

14. The inner support panel, as recited in claim 1, wherein each of the first panel portion and the second panel portion further comprises a third layer, wherein the second layer is formed between the first layer and the third layer, wherein the first layer of each of the first panel portion and the second panel portion is an outer layer facing outside and the third layer of each of the first panel portion and the second panel portion is an inner layer facing the cavity, wherein one or more parts of the third layer of the first panel portion and one or more parts of the third layer of the second panel portion are joined with each other at the one or more peak points of each of the plurality of support members.

15. The inner support panel, as recited in claim 1, wherein the first layer of each of the first panel portion and the second panel portion is an outer layer facing outside and the second layer of each of the first panel portion and the second panel portion is an inner layer facing the cavity, wherein the first layer of each of the first panel portion and the second panel portion is made of high-density polyethylene and the second layer of reach of the first panel portion and the second panel portion is made of a mixture material selected from the group consisting of high-density polyethylene, metallocene poly ethylene and calcium carbonate, and high-density polyethylene, metallocene polyethylene and glass fiber.

* * * * *